US007083056B2

(12) United States Patent
Routhier

(10) Patent No.: US 7,083,056 B2
(45) Date of Patent: Aug. 1, 2006

(54) WALL MOUNTED STORAGE ORGANISER SYSTEM

(75) Inventor: Raymond Routhier, Ste-Marie (CA)

(73) Assignee: Les Gestions PARMH Inc., Ste-Marie (CA)

( * ) Notice: Subject to any disclaimer, the term of this patent is extended or adjusted under 35 U.S.C. 154(b) by 0 days.

(21) Appl. No.: 09/773,581

(22) Filed: Feb. 2, 2001

(65) Prior Publication Data

US 2002/0104813 A1 Aug. 8, 2002

(51) Int. Cl.
*A47F 5/08* (2006.01)
*A47B 47/00* (2006.01)

(52) U.S. Cl. ..... 211/90.04; 211/94.01; 211/190

(58) Field of Classification Search ..... 211/94.01, 211/90.01, 90.04, 189, 186, 187, 190, 207, 211/87.01; 312/245; 40/757; 52/235; 248/475.1, 248/547

See application file for complete search history.

(56) References Cited

U.S. PATENT DOCUMENTS

| | | | | | |
|---|---|---|---|---|---|
| 2,992,743 | A | * | 7/1961 | Wing | 108/48 |
| 3,870,157 | A | * | 3/1975 | Hayward | 211/90.01 |
| 4,134,238 | A | * | 1/1979 | Auger | 52/127 |
| 4,143,846 | A | | 3/1979 | Rock et al. | |
| 4,457,436 | A | * | 7/1984 | Kelley | 211/88.01 |
| 4,508,231 | A | * | 4/1985 | Honickman | 211/199 |
| 4,518,089 | A | * | 5/1985 | Campbell | 211/118 |
| 4,712,761 | A | * | 12/1987 | Wassell | 248/475.1 |
| 4,754,948 | A | * | 7/1988 | Casciani | 248/680 |
| 4,928,833 | A | | 5/1990 | Huizenga | |
| 4,973,021 | A | * | 11/1990 | Schuite | 248/495 |
| 5,050,832 | A | * | 9/1991 | Lee et al. | 248/225.11 |
| 5,076,525 | A | * | 12/1991 | Whipple | 248/300 |
| 5,191,986 | A | | 3/1993 | Huizenga | |
| 5,222,611 | A | | 6/1993 | Wood et al. | |
| 5,309,686 | A | * | 5/1994 | Underwood et al. | 52/29 |
| 5,332,108 | A | * | 7/1994 | Blass | 211/90.02 |
| 5,392,934 | A | | 2/1995 | Fox | |
| 5,439,123 | A | * | 8/1995 | Nook | 211/187 |
| 5,678,797 | A | * | 10/1997 | Gogan | 248/251 |
| 5,687,856 | A | * | 11/1997 | Kendrena | 211/70.6 |
| 5,718,493 | A | * | 2/1998 | Nikolai | 312/245 |
| 5,794,396 | A | * | 8/1998 | Gibbs | 52/518 |
| 5,819,958 | A | * | 10/1998 | Dement | 211/90.01 |
| 5,848,711 | A | * | 12/1998 | Schmit | 211/90.04 |
| 5,964,438 | A | * | 10/1999 | Camilleri | 248/225.21 |
| 6,113,201 | A | * | 9/2000 | Bauer | 312/245 |
| 6,286,802 | B1 | * | 9/2001 | Munson et al. | 248/475.1 |

FOREIGN PATENT DOCUMENTS

| | | |
|---|---|---|
| CA | 1307766 | 9/1992 |

OTHER PUBLICATIONS

NIL.

* cited by examiner

*Primary Examiner*—Jennifer E. Novosad
(74) *Attorney, Agent, or Firm*—Ogilvy Renault LLP

(57) ABSTRACT

A storage organizer system comprises a horizontal rail adapted to be securely mounted to a wall and a number of storage units adapted to be hung from the rail. Each unit includes at least one metal hook extending rearwardly from the unit for engaging the rail and a spacer for engaging the wall so as to support the wall in a vertical position at a distance from the wall. This arrangement provides ease of installation and a sturdy overall construction.

11 Claims, 3 Drawing Sheets

WALL MOUNTED STORAGE ORGANISER SYSTEM

BACKGROUND OF THE INVENTION

1. Field of the Invention

The present invention relates to storage organizers and, more particularly, to wall mounted storage organizers.

2. Description of the Prior Art

Systems for use as storage organizers in closets and the like are well known. For instance, U.S. Pat. No. 4,928,833 issued on May 29, 1990, to Huizenga discloses a storage organizer system comprising a number of upright panels, each having a rear edge with a cut out shaped to receive a projection of a horizontal rail securely mounted on a wall on which the system has to be installed. The panels are hung directly on the rail with the rear edge of each panel abutting against the wall.

Although the system described in the above patent offers ease of installation, it has been found that there is a need for a new wall mounted organizer system which is less sensitive to the irregularities and imperfections of the wall surface to which it has to be mounted and which offers increased load bearing capacities.

SUMMARY OF THE INVENTION

It is therefore an aim of the present invention to provide a storage organizer system which offers ease of installation.

It is also an aim of the present invention to provide a storage organizer system which is of sturdy construction.

It is a further aim of the present invention to provide a new manner of mounting a storage organizer to a vertical surface.

It is a still further aim of the present invention to provide a storage organizer system which is relatively simple and economical to manufacture.

Therefore, in accordance with the present invention, there is provided a storage organizer system comprising a rail adapted to be securely mounted to a substantially flat vertical surface, a storage unit including at least two laterally spaced-apart upright panels having front and rear portions, and at least one rail engaging member mounted to the two laterally spaced-apart upright panels and extending towards the rear, and adapted to engage the rail for suspending the unit from the rail.

In accordance with a further general aspect of the present invention, there is provided a method of mounting a storage organizer unit on a substantially flat vertical surface, comprising the steps of: a) mounting a rail on a substantially flat vertical surface, b) providing a storage organizer unit and at least one rail engaging member, c) mounting said at least one rail engaging member to said storage organizer unit, and d) suspending said storage organizer unit from said rail by engaging said rail engaging member with said rail.

In accordance with a further general aspect of the present invention, there is provided a storage organizer system comprising a rail adapted to be fixed to a vertical surface, a storage organizer unit for supporting some articles, a rail engaging member mounted to said storage organizer unit and projecting rearwardly therefrom for hanging said storage organizer unit from said rail, and a surface engaging member extending between said storage organizer unit and the vertical surface at a distance from said rail engaging member for cooperating therewith in supporting said storage organizer unit in a substantially vertical position.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
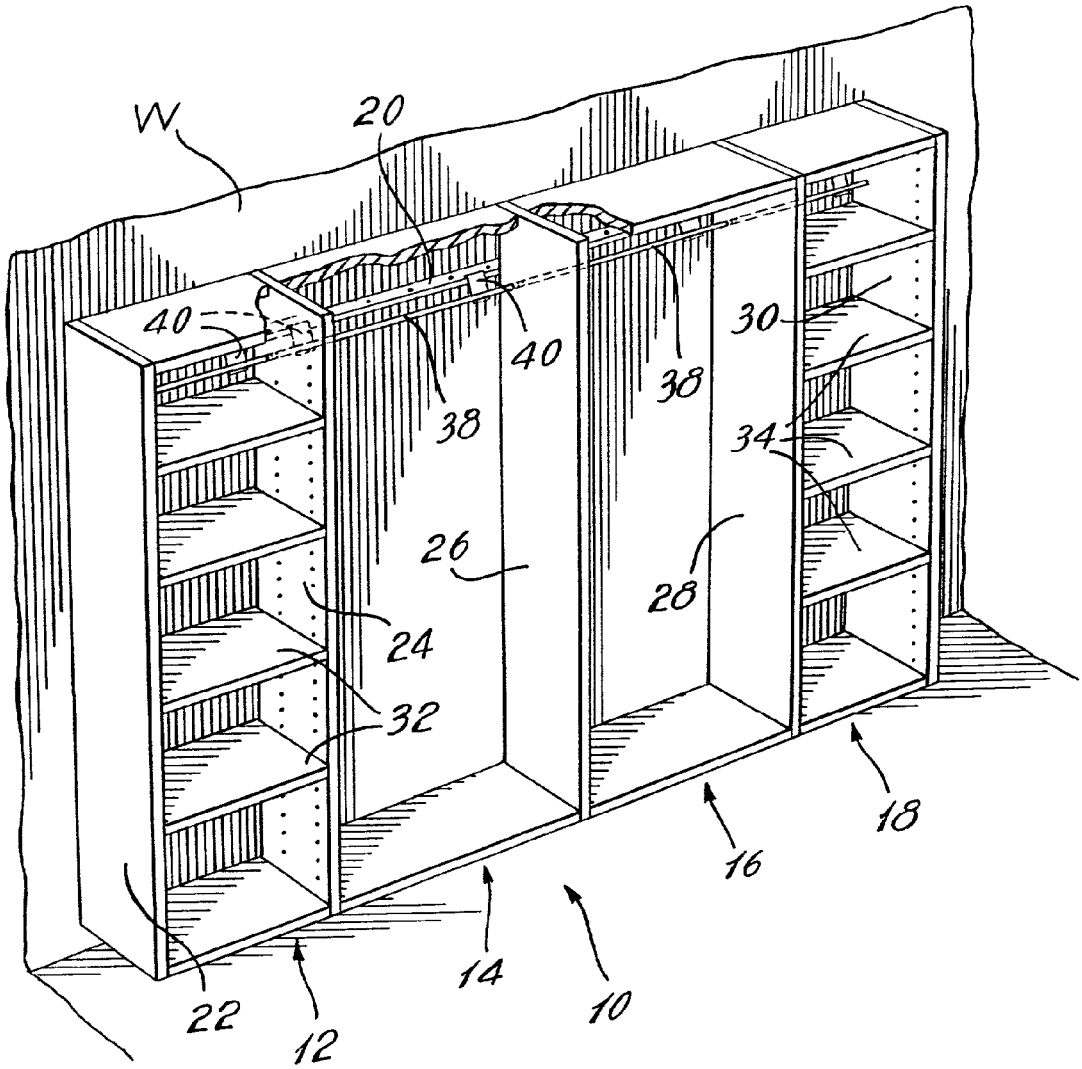
FIG. 1 is a perspective view of a storage organizer system in accordance with a first embodiment of the present invention.

Now referring to the drawings, and in particular to FIG. 1, a storage organizer system embodying the elements of the present invention and generally designated by numeral 10 will be described.

More particularly, the system 10 preferably comprises a number of side-by-side storage organizer units or compartments 12, 14, 16 and 18 assembled together as a modular unit and hanging from a horizontal rail 20 securely mounted on a substantially flat vertical surface, such as a wall W. The compartments 12, 14, 16 and 18 are essentially form by a plurality of laterally spaced-apart upright panels 22, 24, 26, 28 and 30. Some or all of the compartments can be provided with shelving to support various items. For instance, first and second series of vertically spaced-apart shelves 32 and 34 can be respectively mounted between a first pair of panels formed by upright panels 22 and 24 and a second pair of panels formed by upright panels 28 and 30. The intermediate compartments 14 and 16 can be provided at respective upper ends thereof with rods for allowing hanging of clothes or the like. However, each compartment is preferably provided with top and bottom shelves.

Figure 2:
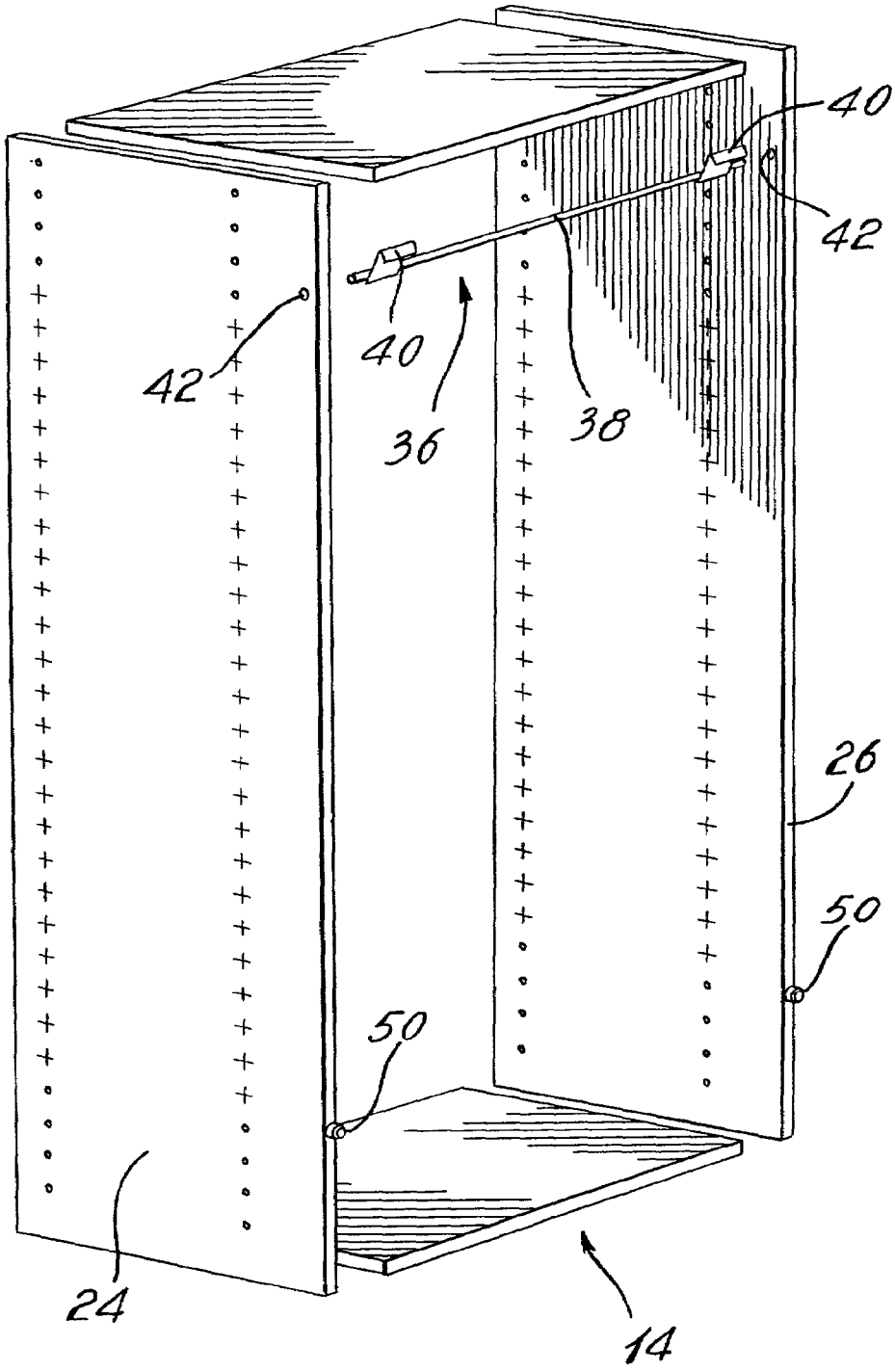
FIG. 2 is a rear perspective view of a unit of the storage organizer system of FIG. 1.

As illustrated in FIG. 2 in connection with compartment 14, each compartment is provided with a hanging structure 36 adapted to be engaged with the horizontal rail 20 to retain the associated compartment of unit in a vertical suspended position adjacent the wall W.

The hanging structure 36 includes a rod 38 and a pair of inverted J-shaped hooks 40 mounted on the rod 38 between opposed ends thereof. The rod 38 extends across the compartment 14 and the opposed ends of the rod 38 are received in corresponding circular holes 42 defined in panels 24 and 26. If desired, the rod 38 can be mounted to the panels 24 and 26 so as to allow the rod 38 to rotate about a longitudinal axis thereof relative to the panels 24 and 26. A series of vertically spaced-apart holes, similar to holes 42, could be provided in the panels 24 and 26 for allowing the rod 38 to be installed at various heights in compartment 14. The hooks 40 can be securely or freely mounted on the rod 38. For instance, the hooks 40 can be welded to the rod 38 or, alternatively, formed with a loop at one end thereof for allowing the same to be slidably fitted on the rod 38. In the latter case, the rod 38 can be stamped at selected locations, intermediate the opposed ends thereof, to limit axial movement of the hooks 40 thereon.

Figure 3:
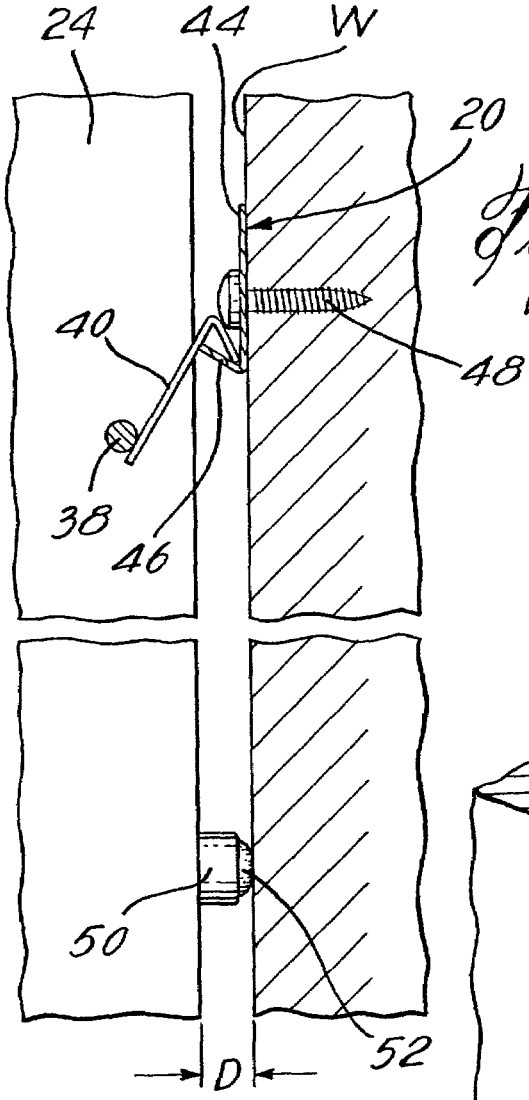
FIG. 3 is an enlarged elevational side view of the unit of FIG. 2, illustrating how the same is mounted to a vertical surface, such as a wall.

As illustrated in FIG. 3, the hooks 40 are adapted to be engaged with the rail 20 to support the compartment or unit 14 on the wall W. The rail 20 has first and second legs 44 and 46 extending at an acute angle from each other and defining a J-shaped configuration. A plurality of axially spaced-apart holes (not shown) are defined along the first leg 44 for receiving fasteners, such as screws 48, in order to secure the rail 20 to the wall W. The second leg 46 projects upwardly from a lower end of the first leg 44 away from the wall W and cooperates with the hooks 40 for supporting the compartment 14 above the floor.

Spacers are provided at the lower end of each compartment for engaging the wall W so as to maintain the compartments in a vertical position at a distance D from the wall W. As exemplified with respect to compartment 14, each spacer can be provided in the form of a pair of projections 50 extending rearwardly from respective rear edges of the compartment upright panels. Each projection 50 is preferably provided with a rounded distal end 52 made of a cushion-type material, such as rubber.

By hanging the panels 22, 24, 26, 28 and 30 of the compartments 12, 14, 16 and 18 at a distance from the wall W with discrete points of contact between the compartments and the wall W, the mounting of the storage organizer system 10 to the wall W is less affected by irregularities or imperfections often present on walls. Indeed, if the rear edges of the upright panels 22, 24, 26, 28 and 30 were in intimate contact with the wall W, the angular position of the panels 22, 24, 26, 28 and 30 relative to the anchoring points thereof would be dictated by the wall W. In the event that the wall W is not perfectly vertical, this would result in forces, which will tend to pull the rail 20 away from the wall W. This would also result in the storage organizer units 12, 14, 16 and 18 being at an angle from the vertical, which is obviously not suitable.

Moreover, the use of hooks allows heavier loads to be transferred to the rail 20, as compared to current storage organizer system in which the upright wooden panels are directly hung on the rail. The present hanging arrangement provides a more sturdy construction.

The rail 20, the rod 38 and the hooks 40 are preferably made of metal and the upright panels 22, 24, 26, 28 and 30 of laminated wood or the like.

The storage organizer system 10 can be sold as a knock-down kit to be assembled by the purchaser. The rail 20 is first securely mounted on the wall W along a horizontal axis located at a predetermined height above the floor. Thereafter, one compartment, for instance compartment 14, is assembled by mounting the top and bottom shelves and the rod 38 between the panels 24 and 26, as illustrated in FIG. 2. The assembled compartment 14 is then hung on the rail 20 at a selected location thereon by engaging the hooks 40 in the rail 20. The other compartments are assembled in a similar way. If desired, a selected number of side-by-side compartments can be assembled together before being hung on the rail 20.

It is understood that more than one section of rail 20 can be used.

Figure 4:
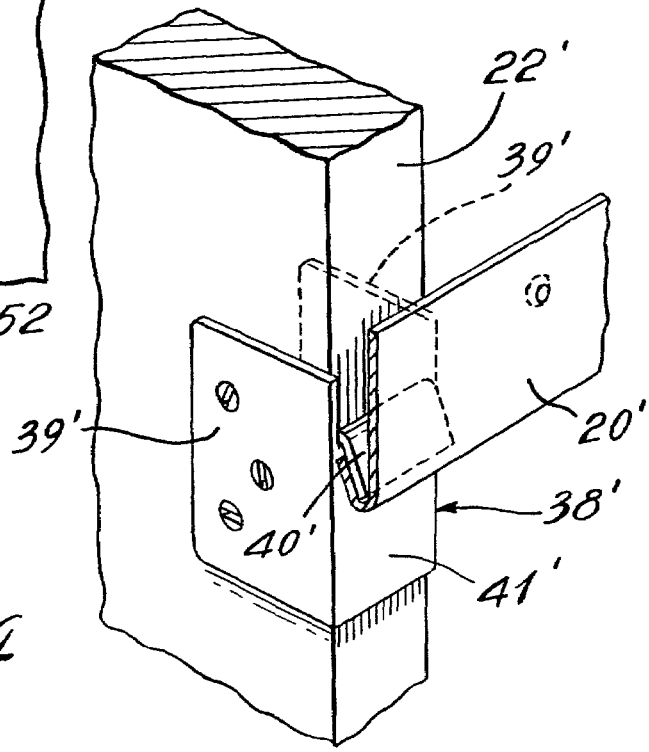
FIG. 4 is an enlarged perspective view of a hook structure used for mounting a panel of a storage organizer unit to a vertical surface in accordance with a second embodiment of the present invention.

FIG. 4 illustrates another possible construction of a hanging structure or rail engaging member which can be used to hang a storage organizer unit from rail 20' securely mounted on a wall.

According to this construction, a bracket 38' having a hook formation 40' is securely mounted to each upright panels of a compartment. As illustrated in FIG. 4 in connection with panel 22', the bracket 38' has a pair of parallel arms 39' extending integrally at right angles from opposed ends of a web member 41'. The bracket 38' is installed on the panel 22' with the arms 39' extending over opposed sides of the panel 22' and the web member 41' uniformly abutting against the rear edge of the panel 22'. Fasteners, such as screws, are used to secure the bracket 38' to the panel 22'. The hook formation 40' extends downwardly from an upper end of the web member 41' and rearwardly of the panel 22' for suspending the same from the rail 20', as shown in FIG. 4.

The invention claimed is:

1. A storage organizer system comprising a rail adapted to be securely mounted to a substantially flat vertical surface, a storage unit including at least two laterally spaced-apart upright panels having front and rear portions, each of said upright panels having a cutout-free rear edge, at least one rail engaging member mounted to the two laterally spaced-apart upright panels and extending towards the rear, said rail engaging member being adapted to engage the rail for suspending the unit from the rail, a spacer extending rearwardly from each of said upright panels at a distance from said rail engaging member for defining a gap (D) behind said storage unit once installed on said rail, wherein said rail engaging member is removably securable at various vertically spaced-apart fixed locations along a major portion of the length of said cutout-free fear edges of spaced-apart upright panels in vertically spaced-apart holes defined along said at least two spaced-apart upright panels.

2. A storage organizer system as defined in claim 1, wherein said rail engaging portion has a hooked end for engagement at a selected location in said rail.

3. A storage organizer system as defined in claim 2, wherein said at least one rail engaging member includes a distinct rail engaging member for each panel, each said distinct rail engaging member being provided in the form of a bracket adapted to be secured to a corresponding panel of said at least two laterally spaced-apart upright panels.

4. A storage organizer system as defined in claim 3, wherein said bracket includes a pair of parallel arms extending from opposed ends of a web member for receiving said corresponding panel therebetween with said web member covering an underlying portion of a rear edge of said corresponding panel, and a hook extending rearwardly from said web member for engaging said rail.

5. A storage organizer system as defined in claim 1, wherein said rail engaging member includes a transversal member extending across said at least two laterally spaced-apart upright panels, and at least one hook mounted to said transversal member between said at least two laterally spaced-apart upright panels for engagement with said rail.

6. A storage organizer system as defined in claim 5, wherein said transversal member is allowed to rotate about a longitudinal axis thereof relative to said at least two spaced-apart upright panels.

7. A storage organizer system as defined in claim 6, wherein said transversal member is provided in the form of a rod received at opposed ends thereof in first and second circular holes respectively provided in said at least two laterally spaced-apart panels.

8. A storage organizer system as defined in claim 1, wherein said spacer is provided at a bottom end portion of said at least two laterally spaced-apart upright panels.

9. A storage organizer system as defined in claim 1, wherein said spacer includes a projection extending rearwardly from a rear edge of each of said at least two laterally spaced-apart panels.

10. A storage organizer system as defined in claim 1, wherein said rail includes first and second legs extending at an acute angle from each other, said first legs defining a number of holes adapted to receive fasteners for horizontally securing said rail to the vertical surface with said second leg projecting upwardly.

11. A storage organizer system as defined in claim 10, wherein said rail has a J-shape, whereas said rail engaging portion has an inverted J-shape.

* * * * *